US011047607B2

(12) United States Patent
Kim et al.

(10) Patent No.: US 11,047,607 B2
(45) Date of Patent: Jun. 29, 2021

(54) SHROUD FOR REFRIGERATOR

(71) Applicant: LG Electronics Inc., Seoul (KR)

(72) Inventors: Myunghoon Kim, Seoul (KR); Jangseok Lee, Seoul (KR); Eundong Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 1286 days.

(21) Appl. No.: 14/168,027

(22) Filed: Jan. 30, 2014

(65) Prior Publication Data

US 2014/0220880 A1 Aug. 7, 2014

(30) Foreign Application Priority Data

Feb. 6, 2013 (KR) ..... 10-2013-0013198
Feb. 6, 2013 (KR) ..... 10-2013-0013199

(51) Int. Cl.
*F25D 17/06* (2006.01)

(52) U.S. Cl.
CPC ..... *F25D 17/065* (2013.01); *F25D 2317/063* (2013.01); *F25D 2317/067* (2013.01); *F25D 2317/0681* (2013.01)

(58) Field of Classification Search
CPC ... F25D 17/06; F25D 17/065; F25D 2317/063
USPC ..... 454/239, 329
See application file for complete search history.

(56) References Cited

U.S. PATENT DOCUMENTS 4,576,331 A * 3/1986 Harwell ..... F24F 7/065 236/49.1
4,852,470 A * 8/1989 Corriveau ..... F24F 7/06 454/284
5,632,677 A * 5/1997 Elkins ..... F04D 25/16 454/329
6,139,427 A * 10/2000 Yi ..... F04D 29/4246 181/224
2005/0152781 A1* 7/2005 Baek ..... F04D 29/282 415/206
2006/0240764 A1* 10/2006 Pierce ..... F24F 3/166 454/329
2008/0220712 A1* 9/2008 Hu ..... F24F 7/007 454/258

(Continued)

FOREIGN PATENT DOCUMENTS

CN 1278054 A 12/2000
JP 2002-181435 A 6/2002

(Continued)

*Primary Examiner* — Steven B McAllister
*Assistant Examiner* — Elizabeth M. May
(74) *Attorney, Agent, or Firm* — Birch, Stewart, Kolasch & Birch, LLP

(57) ABSTRACT

There is disclosed a shroud for a refrigerator including a blower for generating air flow; a first region arranged on the right of the blower, the first region comprising an outlet hole for a first storage chamber for exhausting cold air to the first storage chamber; a second region arranged on the left of the blower, the second region comprising an outlet hole for a second storage chamber for exhausting cold air to the second storage; a third region arranged under the blower, the third region comprising an outlet hole for the second storage chamber; and a first guide arranged between the second region and the third region, projected closer to a rotational center of the blower, to guide air flow.

18 Claims, 8 Drawing Sheets

(56) References Cited

U.S. PATENT DOCUMENTS

| | | | | |
|---|---|---|---|---|
| 2008/0256971 | A1 | 10/2008 | Bae et al. | |
| 2011/0287706 | A1* | 11/2011 | Maughan | F24F 13/08 454/329 |
| 2013/0165036 | A1* | 6/2013 | Kudo | G03G 15/0291 454/284 |
| 2014/0215842 | A1* | 8/2014 | Hogan | F26B 21/004 34/218 |

FOREIGN PATENT DOCUMENTS

| | | | |
|---|---|---|---|
| KR | 10-2001-0011784 | A | 2/2001 |
| KR | 10-2003-0039631 | A | 5/2003 |

* cited by examiner

FIG. 5

| INPUT | 9.0V | | | |
|---|---|---|---|---|
| Air flow (CMM) | Outlet for second chamber | First outlet hole | 0.14 | 26% |
| | | Second outlet hole | 0.12 | 22% |
| | | Third outlet hole | 0.05 | 9% |
| | | Fourth outlet hole | 0.13 | 24% |
| | Outlet hole for first storage chamber | | 0.10 | 19% |
| | Total | | 0.54 | |

FIG. 8

| INPUT | 9.0V | | | |
|---|---|---|---|---|
| Air flow (CMM) | Outlet for second chamber | First outlet hole | 0.14 | 22% |
| | | Second outlet hole | 0.14 | 22% |
| | | Third outlet hole | 0.09 | 14% |
| | | Fourth outlet hole | 0.13 | 20% |
| | Outlet hole for first storage chamber | | 0.14 | 22% |
| | Total | | 0.64 | |

SHROUD FOR REFRIGERATOR

Pursuant to 35 U.S.C. § 119(a), this application claims the benefit of Korean Patent Application No. 10-2013-0013198, filed on Feb. 6, 2013 and No. 10-2013-0013199, filed on Feb. 6, 2013, the contents of which are hereby incorporated by reference herein in their entirety.

BACKGROUND OF THE DISCLOSURE

Field of the Disclosure

The present invention relates to a shroud for a refrigerator, more particularly, to a shroud for a refrigerator which has an enhanced efficiency of air flow therein.

Discussion of the Related Art

Generally, a refrigerator is an electric appliance used in freezing or refrigerating foods. Such a refrigerator consists of a case for a storage chamber divided into a freezer compartment and a refrigerator compartment and mechanisms (e.g., a compressor, a condenser, an evaporator and a capillary tube) configured to form a freezing cycle in order to lower temperatures of the refrigerator and freezer compartments.

Doors are coupled to sides of the case to open and close the refrigerator and freezer compartments, respectively.

In the refrigerator having the structure mentioned above, the compressor compresses a low temperature/pressure gaseous refrigerant into a high temperature/pressure refrigerant. While passing through the condenser, the compressed high temperature/pressure gaseous refrigerant is chilled and condensed to be a high pressure liquid refrigerant. After, while passing through the capillary tube, the high pressure and temperature of the liquid refrigerant are lowered to be a low temperature/pressure gas. The low temperature/pressure gas refrigerant absorbs heat nearby and chills ambient air. That freezing cycle mentioned above may perform a cooling process.

The cold air generated by the freezing cycle is provided to the refrigerator or freezer compartment by a shroud.

However, a shroud provided in a conventional refrigerator intensively supplies cold air to a lower portion of the storage chamber where foods are stored. Accordingly, there might be a disadvantage of a relatively big difference between a temperature of an upper portion and a temperature of a lower portion in the storage chamber.

SUMMARY OF THE DISCLOSURE

Exemplary embodiments of the present disclosure provide a shroud for a refrigerator which has an enhanced flow efficiency of air therein.

Exemplary embodiments of the present disclosure provide a shroud for a refrigerator which may increase a storage chamber.

To achieve these objects and other advantages and in accordance with the purpose of the invention, as embodied and broadly described herein, a shroud for a refrigerator includes a blower for generating air flow; a first region arranged on the right of the blower, the first region comprising an outlet hole for a first storage chamber for exhausting cold air to the first storage chamber; a second region arranged on the left of the blower, the second region comprising an outlet hole for a second storage chamber for exhausting cold air to the second storage; a third region arranged under the blower, the third region comprising an outlet hole for the second storage chamber; and a first guide arranged between the second region and the third region, projected closer to a rotational center of the blower, to guide air flow.

The first guide may increase the air flow exhausted via the outlet hole for the second storage chamber provided in the second region.

The third guide may partially shut the air flowing toward the third region.

The first guide may be getting farther from the rotational center of the blower as farther in both lateral directions from a specific point.

The first guide may include a first extended surface extended from the specific point in a direction in which the width of the second region is decreased.

The first guide may include a second extended surface extended from the specific point to maintain the width of the third region.

The specific point may be arranged lower than the rotational center of the blower.

The shroud for the refrigerator may further include a second guide arranged between the first region and the second region, projected closer to the rotational center of the blower.

The second guide may partially shut the air flowing toward the second region.

The second guide may increase the air flow exhausted via the outlet hole for the first storage chamber.

Penetrating holes may be formed in both lateral portions of the third region, respectively.

The two penetrating holes may be in symmetry with respect to the third region.

The first region may include an outlet hole for the second storage chamber.

The shroud for the refrigerator may further include a third guide provided between the first region and the third region, projected toward the second region not to get out of a vertical extension line from the rotational center of the blower, to guide the air flow.

The third guide may increase the air flow exhausted via the outlet for the first storage chamber.

The third guide may partially shut the air flowing toward the third region.

The third guide may guide the air flow toward the third region.

The third guide may be getting farther from the rotational center of the blower in a horizontal direction as getting farther from a specific point in both side directions.

The third guide may include a third extended piece extended from the specific point in a direction in which the width of the first region is decreased.

The third guide may include a second extended piece extended from the specific point in a direction in which the width of the third region is increased.

According to the embodiments of the present disclosure, air flow efficiency inside in the shroud may be enhanced and the air flow exhausted via the plurality of the outlet holes may be distributed uniformly. Especially, the flow the cold air may be guided and distributed uniformly to distribute temperatures inside upper and lower portions of the storage chamber.

Furthermore, an auxiliary space for the storage chamber may be secured and the volume of the storage chamber for storing foods may be increased.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

FIG. 5 is a graph illustrating results of experiments according to one embodiment of the present disclosure;

FIG. 8 is a graph illustrating results of experiments according to the embodiment of FIG. 6.

DESCRIPTION OF SPECIFIC EMBODIMENTS

Figure 1:
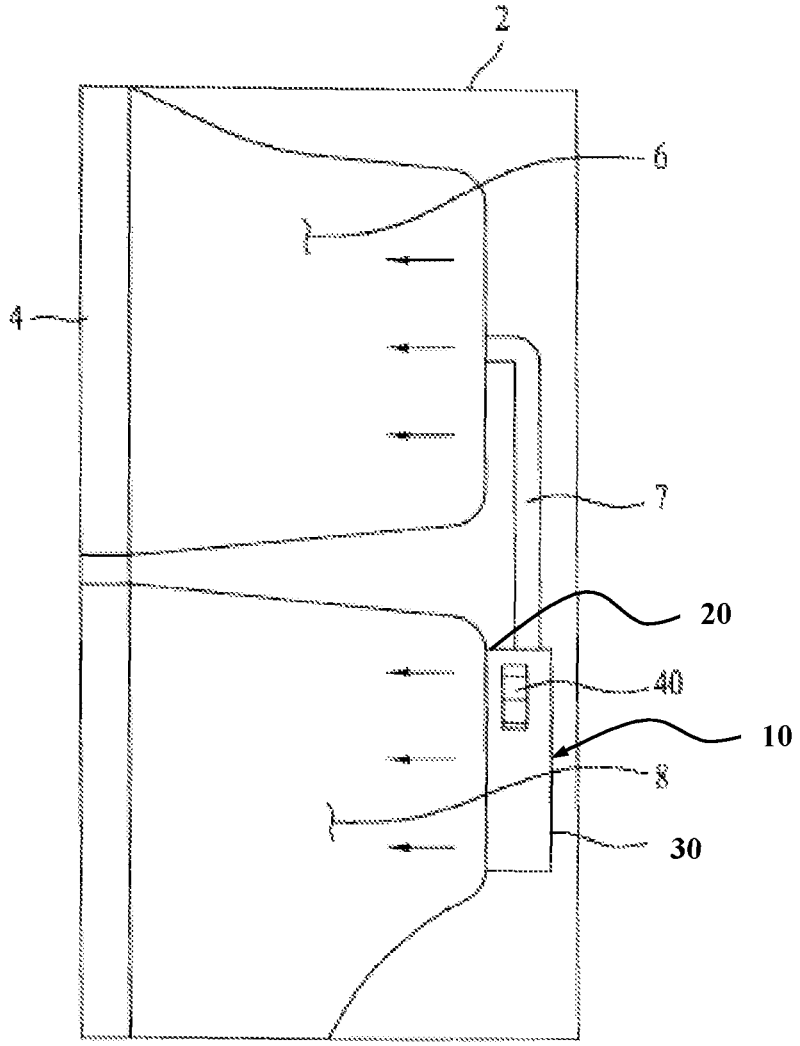
FIG. 1 is a side cut-away view of a refrigerator according to embodiments of the present disclosure.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. In the drawings, the size and relative sizes of layers and regions may be exaggerated for clarity. Like reference numerals in the drawings denote like elements.

FIG. 1 is a side cut-away view of a refrigerator according to embodiments off the present disclosure. Hereinafter, the refrigerator according to the embodiments of the present disclosure will be described, referring to FIG. 1.

The refrigerator includes a case 2 having a plurality of storage chambers 6 and 8 and a door 4 for opening and closing the storage chambers 6 and 8.

The plurality of the storage chambers 6 and 8 may consist of a first storage chamber 6 and a second storage chamber 8. The first storage chamber 6 and the second storage chamber 8 may be employed as a refrigerator compartment and a freezer compartment, respectively. In contrast, the first storage chamber 6 and the second storage chamber 8 may be employed as the freezer compartment and the refrigerator compartment, respectively. Alternatively, both of the first and second storage chambers 6 and 8 may be employed as the refrigerator compartment or the freezer compartment.

Meanwhile, the cold air generated from the evaporator of the freezing cycle is supplied to the first storage chamber 6 and the second storage chamber 8 via a shroud 10. The shroud 10 includes a blower 40 for generating air circulation such that the cold air generated from the evaporator can be forcibly guided to the first storage chamber 6 and the second storage chamber 8.

The shroud 10 may be connected to the second storage chamber 8 at a similar height such that the cold air may be supplied to the second storage chamber 8 via a plurality of outlets provided in the shroud 10.

The shroud 10 is arranged less higher than the first storage chamber 6 and a duct 7 may be provided to connect the shroud 10 and the first storage chamber 6 with each other. Accordingly, the cold air guided by the shroud 10 may be moved into the first storage chamber 6 along the duct 7.

Figure 2:
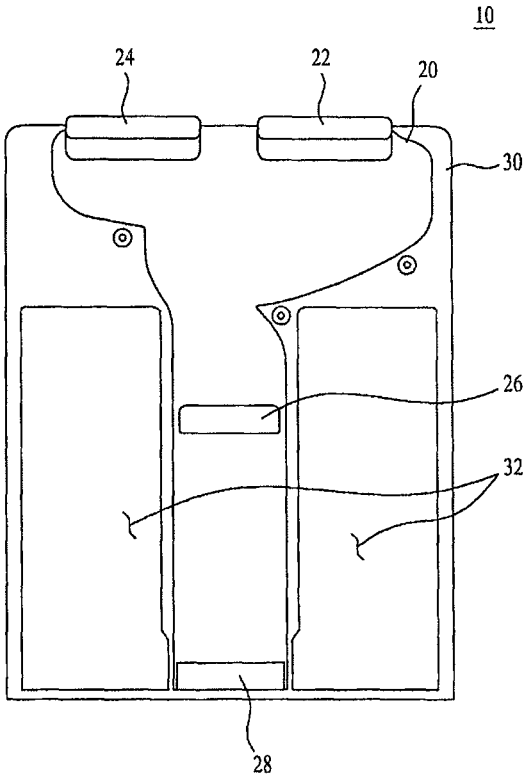
FIG. 2 is a diagram illustrating a front surface of a shroud for a refrigerator according to embodiments of the present disclosure.

FIG. 2 is a diagram illustrating a front surface of the shroud provided in the refrigerator according to the embodiments of the present disclosure. Hereinafter, the front surface of the shroud will be described, referring to FIG. 2.

The shroud 10 may include a base 30 and a cover 20 fixed to the base 30. The base 30 may have an appearance of a square plate. The cover 20 may form a closed passage from the base 20 to allow air flow, with a predetermined height from the base 30. Accordingly, the air may flow along the space provided between the cover 20 and the base 30.

A plurality of outlet holes may be provided in the cover 20. And the outlet holes are passages for supplying the cold air to the second storage chamber 8 from the shroud 10. The plurality of the outlet holes for supplying the cold air to the second storage chamber 8 may consist of a first outlet hole 22, a second outlet hole 24, a third outlet hole 26 and a fourth outlet hole 28.

When seeing the shroud 10, the first outlet hole 22 may be arranged in an upper right portion and the second outlet hole 24 may be arranged in an upper left portion. The third outlet hole 26 may be arranged in a middle portion and the fourth outlet hole 28 may be arranged in a lower portion. The shroud 10 including the plurality of the outlet holes for supplying cold air may distribute the cold air to the second storage chamber 8 uniformly and the temperature inside the second storage 8 may be lowered uniformly.

Two penetrating holes 32 may be provided in both side portions of the shroud 10, respectively. The shroud 10 is provided behind the second storage chamber 8 and the second storage chamber 8 may be more projected backward because of the empty space of the penetrating holes 32. At this time, the penetrating holes 32 are arranged for the base 30 to penetrate.

Specifically, the second storage chamber 8 may be more projected backward, passing through the penetrating holes 32 such that an auxiliary space can be additionally secured for the second chamber 8. Accordingly, the inner space of the second chamber 8 can be enlarged and more foods can be stored in the second storage chamber 8, only to enhance spatial efficiency of the entire space inside the refrigerator.

The two penetrating holes 32 may be arranged in symmetry with respect to the central portion of the shroud 10. The penetrating holes 32 may be provided in the portion where the cover is not formed in the base 30.

The cover 20 may be coupled to the base in a shape of "T" and the two penetrating holes 32 may be arranged near a lower part of the T-shape.

Figure 3:
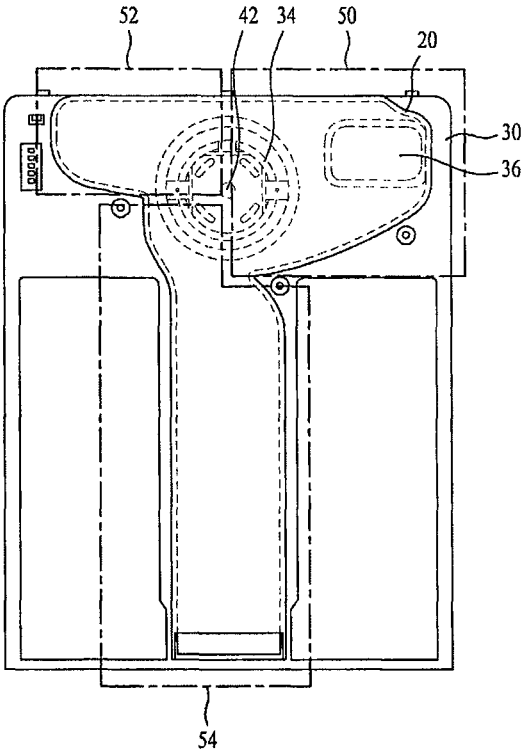
FIG. 3 is a diagram illustrating a base provided in a shroud for a refrigerator according to one embodiment of the present disclosure.
Figure 4:
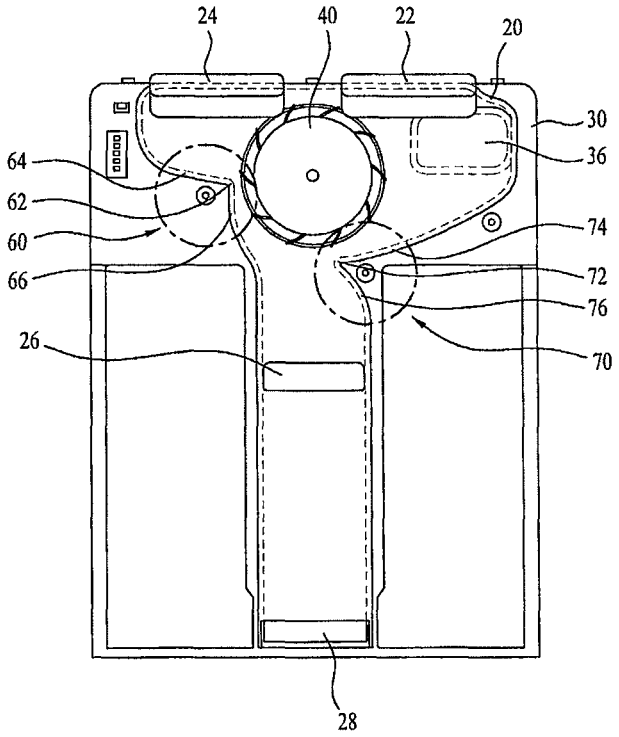
FIG. 4 is a diagram illustrating a cover and the base provided in the shroud according to one embodiment of the present disclosure.

FIG. 3 is a diagram illustrating a base provided in a shroud for a refrigerator according to one embodiment of the present disclosure and FIG. 4 is a diagram illustrating a cover and the base provided in the shroud according to one embodiment of the present disclosure. Referring to FIGS. 3 and 4, the base and the cover of the shroud according to one embodiment will be described.

FIG. 3 substantially illustrates the base without the cover 20. To describe an installation position of the cover 20 in the base 30, only a profile of the cover 20 over the base 30 is shown in FIG. 3. Also, FIG. 3 illustrates a state where the blower provided in the base 30 is removed. Accordingly, in FIG. 3, the cover 20 is shown as a full line and an inner structure of the base 30 covered by the cover 20 is shown as a dotted line.

FIG. 4 is a diagram illustrating the base 30 together with the cover 20. FIG. 4 illustrates the plurality of the outlet holes provided in the cover 20 together with the cover and the base.

A communication hole 34 is provided in the base 30 to move the cold positioned in a rear portion of the base 30 to a front portion of the base 30. At this time, the blower 40 is provided in the communication hole 34 and the cold air positioned in the rear portion of the base 30 to the front portion forcedly.

The blower 40 may include a turbo fan provided to rotate in a counter-clockwise direction with respect to a rotational center 42. Once the blower 40 starts to rotate, the air may be guided from the rear portion toward the front portion of the base 30.

The shroud 10 may include a first region 50 arranged right on the blower 40, a second region 52 arranged left on the blower 40 and a third region 54 arranged under the blower 40. The first region 50, the second region 52 and the third region 54 may form a passage for the air to flow in the shroud 10. The cold air may flow through outlets of the regions.

The first region 50 has an outlet hole 36 for the first storage chamber to exhaust the cold air and the first outlet hole 22 as an outlet hole for the second storage chamber to guide the cold air to the second storage chamber 8. The outlet hole 36 for the first storage chamber may be connected to the duct 7 mentioned above, referring to FIG. 1.

The outlet hole 36 for the first storage chamber is provided in the base 30 and the first outlet hole 22 may be provided in the cover 20.

The second region 52 has the second outlet hole 24 as an outer hole for the second storage chamber to exhaust the cold air to the second storage chamber. The second outlet hole 24 may be provided in the cover 20.

The third region 54 has the third outlet hole 26 as an outlet hole for the second storage chamber and the fourth outlet hole 28. The third outlet hole 26 and the fourth outlet hole 28 may be provided in the cover 20. At this time, the third outlet hole 26 is arranged higher than the fourth outlet hole 28 such that the cold air supplied to the second storage chamber 8 can be dispersed in the second storage chamber 8 uniformly.

The shroud 10 may further include a first guide 60 provided between the second region 52 and the third region 54, projected toward the rotational center 42 of the blower 40. The first guide 60 may guide the air flowing to the second region 52 and the third region 54.

The first guide 60 may increase the flow of the air exhausted via the second outlet hole 24 of the second region 52. That is because the first guide 60 can partially shut the flow of the air toward the third region 54 blown by the blower 40.

The blower 40 rotates in the counter-clockwise direction and the air flow may be performed in the counter-clockwise direction with respect to the blower 40. Accordingly, the first guide 60 may restrict the air flow toward the first region 54. The amount of the air staying in the second region 52 may increase and the pressure inside the second region 52 may increase, such that the amount of the air exhausted via the second outlet hole 24, in other words, the cold air can increase.

The first guide 60 may get farther from the rotational center 42 of the blower 40 as getting farther from a specific point 62 in both lateral directions. The specific point 62 may be a point boundary between the second region 52 and the third region 54. In other words, as getting closer toward the second region 52 and the third region 54 from the specific point 62, the boundary of the air flow may be getting farther from the rotational center of the blower 40.

The first guide 60 may include a first extended surface 64 extended from the specific point 62 toward a direction in which the width of the second region 52 can be reduced. The first extended surface 64 may be extended to face an upper boundary of the second region 52, to form a boundary of the second region 52.

The first guide 60 may include a second extended surface 66 extended from the specific point 62 to maintain the width of the third region 54. The second extended surface 66 may be extended to face a right boundary of the third region 54 to form a boundary of the third region 54.

The first extended surface 64 and the second extended surface 66 are provided on both sides of the specific point 62. The first and second extended surfaces 64 and 66 are arranged farther from the rotational center 42 than the specific point 62.

Meanwhile, the specific point 62 may be arranged lower than the rotational center 42 of the blower 40. The blower 40 rotates in the counter-clockwise direction. Accordingly, when the specific point 62 is lower than the rotational center 42 of the blower 40, a more amount of air flow exhausted via the second outlet hole 24 can be secured.

Moreover, the shroud 10 may include a third guide 70 provided between the first region 50 and the third region 54, projected toward the second region 52 not to get out of a vertical extension line from the rotational center 42 of the blower 40. The third guide 70 may guide the air flowing toward the first region 50 and the third region 54.

When seeing FIGS. 3 and 4, the third guide 70 is arranged more to the right than the rotational center 42. Specifically, the third guide 70 is projected to the left from the first region 50 and the third region 54, not more projected than the rotational center 42. The first guide 70 is positioned to the right, compared with the rotational center 42.

The third guide 70 can increase the amount of the air supplied to the first region 50 and then increase an air pressure inside the first region 50. Accordingly, the third guide 70 may increase the air flow exhausted via the outlet hole 36 for the first storage chamber.

The third guide 70 may partially shut the air flowing toward the third region 54 and it may guide the air flow toward the first region 50. In other words, as the third guide 70 is arranged relatively adjacent to the rotational center 42, a predetermined amount of the air which can flow to the third region 54 from the blower 40 may flow to the third region 50. Accordingly, the air flowing to the third region 54 may decrease and the air flowing to the first region 50 may increase.

Meanwhile, the third guide 70 is getting farther from the rotational center 42 of the blower 40 in a horizontal direction, as getting farther from a specific point 72 in both lateral directions. In other words, the first guide 70 may be extended rightward from the specific point 72.

The third guide 70 may include a first extended piece 74 extended from the specific point 72 in a direction in which the width of the first region 50 is reduced. The first extended piece 74 may be extended to face an upper boundary of the first region 50, to form a boundary of the first region 50.

The third guide 70 may further include a second extended piece 76 extended in a direction in which the width of the third region 54 is reduced. The second extended piece 76 may be extended to face a left boundary of the third region 54, to form a boundary of the third region 54.

The penetrating holes 32 may be symmetrically arranged on both sides of the third region 54. The air is guided only to the third region 54 and the other region in the lower portion of the shroud 10, except the third region 54 may be less important relatively.

Accordingly, the penetrating holes 32 are formed in the region which can be omitted and an auxiliary space can be secured to increase the inner space of the second storage chamber 8.

FIG. 5 is a graph illustrating results of experiments according to one embodiment of the present disclosure. Hereinafter, the results of the experiments will be described, referring to FIG. 5.

Once the blower 40 rotates in the counter-clockwise direction, the air including cold air positioned in the rear portion of the base 30 is flowing to the front portion of the base 30 via the communication hole 34. At this time, the air flow may include a mobility rotated in the counter-clockwise direction by the rotation of the blower 40.

The air flow may be performed to the first storage chamber 6 and the second storage chamber 8 via the outlet hole 36 for the first storage chamber, the first outlet hole 22, the second outlet hole 24, the third outlet hole 26 and the fourth outlet 28.

A predetermined amount of the air flow blown to the second region 52 by the blower 40 stays in the second region 52, not flowing to the third region 54 by the first guide 60. That is because the first guide 60 is arranged relatively closer to the rotational center 42. The air pressure inside the second region 52 is increased and the air flow exhausted via the second outlet hole 24 may be then increased.

As an entrance of the passage of the air guided toward the third region 54 by the first guide 60 gets small, the air flow directly supplied to the third region 54 from the blower 40 is decreased. Those features result in increasing the air flow supplied to the second region 52 and then the air flow exhausted via the second outlet 24 may be increased.

Similarly, an entrance of a passage of the air guided toward the third region 54 by the third guide 70 gets small and the air flow directly supplied to the third region 54 from the blower 40 may be decreased. Accordingly, the air flow supplied to the first region 50 is increased and the amount of the air exhausted via the outlet hole 36 for the first storage chamber may be then increased.

As shown in FIG. 5, the amount of the air supplied outside is 0.54 CMM with respect to an input pressure of 9V supplied to the blower 40. The amount of the air supplied via the first outlet hole 22 is 0.14 CMM, the amount of the air supplied to the second outlet hole 24 is 0.12C MM. The amount of the air supplied to the third outlet hole 26 is 0.05 CMM and the amount of the air supplied to the fourth outlet hole 28 is 0.13 CMM. Also, the amount of the air supplied to the outlet hole 36 for the first storage chamber is 0.10 CMM.

Accordingly, a distribution chart of the entire air amount has 26% of the air amount to the first outlet hole 22, 22% of the air amount to the second outlet hole 24, 9% of the air amount to the third outlet hole 26, 24% of the air amount to the fourth outlet hole 28 and 19% of the air amount to the outlet hole 36 for the first storage chamber.

Specifically, the distribution chart of the air supplied to the plurality of the outlet holes is not concentrated on one outlet hole, such that the cold air can be supplied to the second storage chamber 8 as well as to the first storage chamber 6 uniformly.

Figure 6:
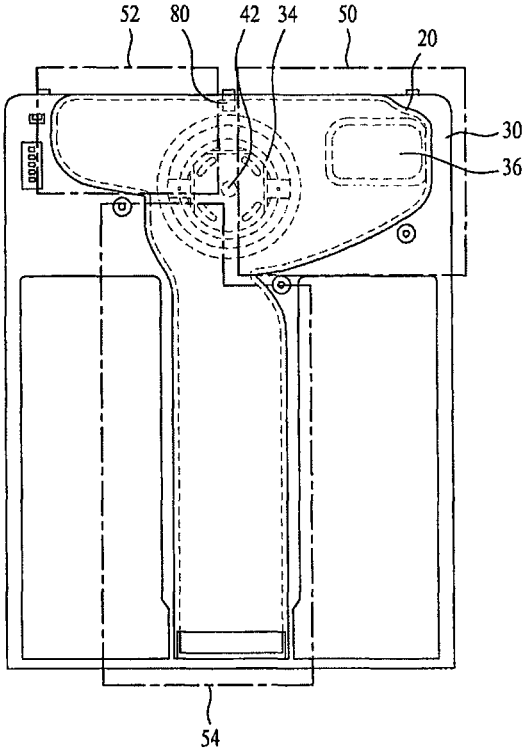
FIG. 6 is a diagram illustrating a base provided in a shroud for a refrigerator according to another embodiment of the present disclosure.
Figure 7:
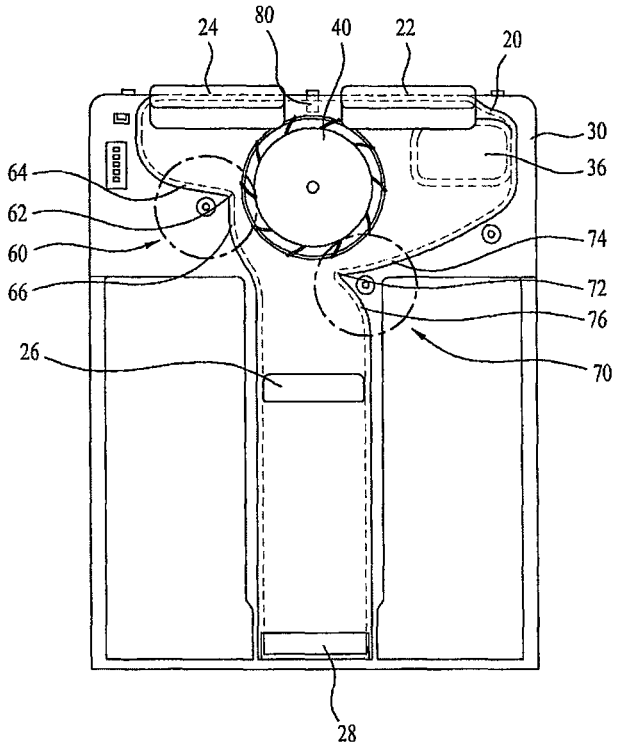
FIG. 7 is a diagram illustrating a cover and the base provided in the shroud for the refrigerator according to the embodiment of FIG. 6.

FIG. 6 is a diagram illustrating a base provided in a shroud for a refrigerator according to another embodiment of the present disclosure. FIG. 7 is a diagram illustrating a cover and the base provided in the shroud for the refrigerator according to the embodiment of FIG. 6. Referring to FIGS. 6 and 7, the base and the cover provided in the shroud according to another embodiment of the present disclosure will be described.

In FIG. 6, the cover 20 is removed and a profile of the cover 20 is shown over the base 30 to make an installation position of the cover with respect to the base 30 understood easily. In FIG. 6, the profile of the cover is shown as a full line and an inner structure of the base covered by the cover is shown as a dotted line. Also, in FIG. 6, the blower 40 provided in the base 30 is removed.

FIG. 7 is a diagram illustrating the cover 20 and the base 30 together and it shows a plurality of outlet holes are provided in the cover 20.

In this embodiment, a second guide 80 is additionally provided, compared with the embodiment shown in FIGS. 3 and 4. The other elements including the first guide 60, the third guide 70, the first region 50, the second region 52 and the third region 54 may be provided. Accordingly, only the second guide 80 will be described and description of the other same elements is omitted. The descriptions and technical features mentioned above are applied to this embodiment.

The shroud 10 may include a second guide 80 provided between the first region 50 and the second region 52, projected to be closer to the rotational center 42 of the blower 40.

The second guide 80 may be projected toward the rotational center 42, with a predetermined thickness from an upper boundary between the first region 50 and the second region 52. At this time, the thickness of the second guide 80 may be determined to allow the second guide 80 to have a predetermined strength for guiding the air flow.

The second guide 80 may be arranged on the same vertical line from the rotational center 42.

The second guide 80 may partially shut the air flow toward the second region 52. In other words, the second guide 80 may form a boundary between the first region 50 and the second region 52 to make a predetermined amount of the air supplied by the blower 40 directly supplied to the first region 50.

The second guide 80 may stop the air flow guided toward the first region 50 from flowing toward the second region 52, such that the air flow exhausted to the outlet 36 for the first storage chamber and the first outlet hole 22 may be increased.

The first outlet hole 22 and the outlet hole 36 for the first storage chamber may be formed in the first region 50. When the amount of the air accommodated by the first region 50 is increased, the air exhausted to the outlet hole 36 for the first storage chamber and to the first outlet hole 22 can be increased.

Especially, a distance between the rotational center 42 and the second guide 80 is smaller than a distance between the specific point 62 of the first guide and the rotational center 42 and the distance is smaller than a distance between the specific point 72 of the third guide 70 and the rotational center 42.

Meanwhile, the distance between the specific point 62 of the first guide 60 and the rotational center 42 may be smaller than the distance between the specific point 72 of the third guide 70 and the rotational center 42.

Specifically, the distance between the rotational center 42 and the second guide 80 is the smallest. The distance between the specific point 62 of the first guide and the rotational center 42 is the middle value. The distance between the specific point 72 of the third guide 70 and the rotational center 42 is the largest.

FIG. 8 is a graph illustrating results of experiments according to the embodiment of FIG. 6. Referring to FIG. 8, the results of the experiments will be descried.

Once the blower 40 rotates in the counter-clockwise direction, the air including cold air positioned in the rear portion of the base 30 is flowing to the front portion of the base 30 via the communication hole 34. At this time, the air flow may include a mobility rotated in the counter-clockwise direction by the rotation of the blower 40.

The air flow may be performed to the first storage chamber 6 and the second storage chamber 8 via the outlet hole 36 for the first storage chamber, the first outlet hole 22, the second outlet hole 24, the third outlet hole 26 and the fourth outlet 28.

A predetermined amount of the air flow blown to the second region 52 by the blower 40 stays in the second region 52, not flowing to the third region 54 by the first guide 60. That is because the first guide 60 is arranged relatively closer to the rotational center 42. The air pressure inside the second region 52 is increased and the air flow exhausted via the second outlet hole 24 may be then increased.

As an entrance of the passage of the air guided toward the third region 54 by the first guide 60 gets small, the air flow directly supplied to the third region 54 from the blower 40 is decreased. Those factures results in increasing the air flow supplied to the second region 52 and then the air flow exhausted via the second outlet 24 may be increased.

Similarly, an entrance of a passage of the air guided toward the third region 54 by the third guide 70 gets small and the air flow directly supplied to the third region 54 from the blower 40 may be decreased. Accordingly, the air flow supplied to the first region 50 is increased and the amount of the air exhausted via the outlet hole 36 for the first storage chamber may be then increased.

Also, the air supplied to the first region 50 from the blower 40 by the second guide 80 may be increased. That is because the second guide 80 is arranged between the first region 50 and the second region 52 and because the blower 40 rotates in the counter-clockwise direction. Without the second guide 80, the air flow directly supplied to the second region 52 might be guided to the first region 50 by the second guide 80.

Especially, after guided to the first region 50 by the second guide 80, the air flow toward the second region 52 may be decreased. That is because the second guide 80 is projected closer to the rotational center 42 only to shut the air flowing to the second region 52 from the first region 50.

As shown in FIG. 8, the amount of the air supplied outside is 0.64 CMM with respect to an input pressure of 9V supplied to the blower 40. The amount of the air supplied via the first outlet hole 22 is 0.14 CMM, the amount of the air supplied to the second outlet hole 24 is 0.14 CMM. The amount of the air supplied to the third outlet hole 26 is 0.09 CMM and the amount of the air supplied to the fourth outlet hole 28 is 0.13 CMM. Also, the amount of the air supplied to the outlet hole 36 for the first storage chamber is 0.14 CMM.

Compared with the embodiment having the input voltage of 9V supplied to the blower 40, it can be checked that the overall air amount is increased.

In addition, a distribution chart of the entire air amount has 22% of the air amount to the first outlet hole 22, 22% of the air amount to the second outlet hole 24, 14% of the air amount to the third outlet hole 26, 20% of the air amount to the fourth outlet hole 28 and 22% of the air amount to the outlet hole 36 for the first storage chamber.

Compared with the embodiment mentioned above, this embodiments shows that the overall air amount is increased and that the distribution of the air flow supplied via the plurality of the outlet holes is performed uniformly.

Various variations and modifications of the refrigerator described above are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A shroud for a refrigerator comprising:

a base having a communication hole and defining a back of the shroud;

a cover fixed to the base and defining a front of the shroud; and a blower located at the communication hole and configured to generate air flow from a rear of the base at the back of the shroud to a front of the base adjacent the cover, the blower having a rotational center, wherein the shroud includes:

a first region at a first lateral side of the blower, the first region including an outlet hole for a first storage chamber to exhaust cold air to the first storage chamber, the outlet hole for the first storage chamber provided in the base, wherein at least a portion of the outlet hole for the first storage chamber is provided at a same vertical height as the blower, a second region at a second lateral side of the blower, the second region including an outlet hole for a second storage chamber to exhaust cold air to the second storage chamber, the outlet hole for the second storage chamber provided in the second region being provided in the cover, wherein the outlet hole for the second storage chamber provided in the second region is provided in a vertical direction above the outlet hole for the first storage chamber, a third region below the blower in the vertical direction, the third region including an outlet hole for the second storage chamber to exhaust cold air to the second storage chamber, the outlet hole for the second storage chamber provided in the third region being in the cover, wherein the outlet hole for the second storage chamber provided in the third region is provided below the blower in the vertical direction, and at least one guide arranged between two adjacent regions of the first region, the second region and the third region, the at least one guide extending generally toward the rotational center of the blower to guide air flow, wherein air flows are discharged via the outlet holes for the second storage chamber toward different positions of the second storage chamber, wherein air flows from the blower to the outlet hole for the second storage chamber provided in the third region descends from the blower, wherein the first storage chamber and the second storage chamber are separated from each other, wherein cold air via the outlet hole of the second region and cold air via the outlet hole of the third region are mixed in the second storage chamber and cool the second storage chamber together, and wherein the at least one guide includes:

a first guide arranged between the second region and the third region, a second guide arranged between the first region and the second region, and a third guide provided between the first region and the third region, the third guide extending towards the rotational center of the blower without passing through an imaginary vertical line passing through the rotational center of the blower.

2. The shroud according to claim 1, wherein the first guide is configured such that the air flow exhausted via the outlet hole for the second storage chamber provided in the second region is exhausted at a greater volume than the air flow exhausted via the outlet hole for the second storage chamber provided in the third region.

3. The shroud according to claim 2, wherein the third guide restricts the air flow toward the third region.

4. The shroud according to claim 1, wherein the first guide includes a point closest to the rotational center of the blower and changes direction at the point to extends away from the blower.

5. The shroud according to claim 4, wherein the first guide includes a first extended surface extended from the point in a direction in which a width of the second region is decreased.

6. The shroud according to claim 4, wherein the first guide includes a second extended surface extended from the point to maintain a width of the third region.

7. The shroud according to claim 4, wherein the point is arranged lower than the rotational center of the blower.

8. The shroud according to claim 1, wherein the second guide reduces the air flow toward the second region.

9. The shroud according to claim 1, wherein the second guide increase the air flow exhausted via the outlet hole for the first storage chamber.

10. The shroud according to claim 1, further comprising penetrating holes formed at opposite lateral portions of the third region.

11. The shroud according to claim 10, wherein the penetrating holes are symmetrical with respect to the third region.

12. The shroud according to claim 1, wherein, in the first region, the cover comprises an outlet hole for the second storage chamber.

13. The shroud according to claim 1, wherein the third guide increases the air flow exhausted via the outlet for the first storage chamber.

14. The shroud according to claim 1, wherein the third guide reduces the air flow toward the third region.

15. The shroud according to claim 1, wherein the third guide guides the air flow toward the third region.

16. The shroud according to claim 1, wherein the third guide includes a point closest to the rotational center of the blower and changes direction at the point to extend away from the blower.

17. The shroud according to claim 16, wherein the third guide includes a first extended piece extended from the point in a direction in which the width of the first region is decreased.

18. The shroud according to claim 16, wherein the third guide includes a second extended piece extended from the point in a direction in which the width of the third region is increased.

* * * * *